US006948266B1

(12) United States Patent
Steedman et al.

(10) Patent No.: US 6,948,266 B1
(45) Date of Patent: Sep. 27, 2005

(54) VEHICULAR ARM ASSEMBLY

(76) Inventors: Garry Roger Steedman, Malaghan Road, RD1, Queenstown (NZ); Helmut Kanzler, Obere Hauptstrasse 39, 89269, Vohringen (DE)

( * ) Notice: Subject to any disclaimer, the term of this patent is extended or adjusted under 35 U.S.C. 154(b) by 0 days.

(21) Appl. No.: 10/088,323

(22) PCT Filed: Sep. 8, 2000

(86) PCT No.: PCT/NZ00/00178

§ 371 (c)(1),
(2), (4) Date: Feb. 24, 2003

(87) PCT Pub. No.: WO01/18314

PCT Pub. Date: Mar. 15, 2001

(30) Foreign Application Priority Data

Sep. 9, 1999 (NZ) ..... 337739
Sep. 15, 1999 (DE) ..... 299 16 223 U

(51) Int. Cl.[7] ..... E01H 4/00
(52) U.S. Cl. ..... 37/221; 37/464; 37/465; 37/224; 56/154
(58) Field of Search ..... 37/240, 253, 219, 37/220, 221, 222, 223, 305, 462, 464, 465, 37/224; 56/3, 14.5, 14.7, 154, 162

(56) References Cited

U.S. PATENT DOCUMENTS 3,710,472 A * 1/1973 Gremillion et al. ..... 29/891
4,204,575 A * 5/1980 Richardson et al. ..... 172/1
4,277,899 A * 7/1981 Guthoff ..... 37/443
4,445,312 A * 5/1984 Cartner ..... 56/15.5
4,459,767 A * 7/1984 Cartner ..... 37/365
4,502,269 A * 3/1985 Cartner ..... 56/15.5
4,506,464 A * 3/1985 Cartner ..... 37/91
4,612,715 A * 9/1986 Cartner ..... 37/92
4,712,320 A * 12/1987 Cartner ..... 37/92
4,986,010 A * 1/1991 Cartner ..... 37/382
5,940,995 A * 8/1999 Venhomaa ..... 37/240
5,970,634 A * 10/1999 Dann et al. ..... 37/301
6,085,445 A * 7/2000 Kanzler ..... 37/222
6,367,176 B1 * 4/2002 Zaugg et al. ..... 37/240

FOREIGN PATENT DOCUMENTS

EP 0745544 B1 3/2000

* cited by examiner

*Primary Examiner*—Victor Batson
(74) *Attorney, Agent, or Firm*—Woodcock Washburn LLP

(57) ABSTRACT

The present invention relates to a device particularly suitable for grooming/shaping various snow terrain features used by recreational snowboarders and/or skiers and includes an adjustable arm assembly (2) attachable at one end to a suitable vehicle and being capable of deployment substantially orthogonally to the direction of movement of said vehicle; said arm being substantially elongated and including two or more articulately connected sections (5, 6, 7) and one or more actuator means (11, 12, 13) capable of changing the orientation at least two of said sections (5, 6, 7) with respect to each other. The invention is also suitable as a means of shaping embankments or features of earth, soil, sand and so forth or for cutting grass or similar undergrowth.

44 Claims, 13 Drawing Sheets

VEHICULAR ARM ASSEMBLY

TECHNICAL FIELD

The present invention relates to a device particularly suitable for grooming/shaping various snow terrain features used by recreational snowboarders and/or skiers such as the walls of a half pipe, jumps, spines, table tops and so forth. However, the invention is also suitable as a means of shaping embankments or features of earth, soil, sand and suchlike or for mowing grass.

BACKGROUND ART

The developments in the field of snowboarding since its inception in the late Eighties, have resulted in the production of boards adapted for a diverse range of snow conditions and environments. The inherent suitability of snowboards for jumps, spins and the whole host of other tricks and aerial manoeuvres has led ski field operators to incorporate man-made terrain features such as kickers, table tops, quarter and half pipes (a combination of such elements often referred to generically as a 'terrain park') to facilitate such manoeuvres/tricks.

A half pipe is a particularly advantageous feature for a ski field as it enables a suitably proficient rider to execute multiple manoeuvres in a relatively short distance and ideally provides a well-defined, consistent take-off and landing areas, i.e. the walls of the half pipe. The disadvantage for a ski field operator is that a half pipe can be very labour-intensive to construct and difficult to maintain in optimum condition. As is well known to those skilled in the art and as may be deduced from the name, a half pipe consists of an elongated trench sloping down a snow covered mountain with symmetrical concave curved side walls extending along each longitudinal edge of the pipe.

Riders typically proceed down the pipe by alternately traversing between and riding up the two side walls, endeavouring to launch from the lip of the side wall to perform some form of aerial manoeuvre before landing back down the face of the side wall and traversing across to the opposing side of the pipe. An ideally shaped half pipe wall is thus formed as a smooth continuous concave curve, extending from the pipe floor and terminating in a substantially vertical top wall section. Producing and maintaining such half pipe walls with the desired curvature is extremely difficult and laborious to achieve manually. Known automated grooming methods employ a specific half pipe groomer attachment located on the front or rear of a conventional snow grooming vehicle. Whilst such attachments can provide a half pipe exhibiting the aforesaid desirable characteristics, the half pipe groomer attachments themselves suffer from several drawbacks, namely:

i. The attachment can be extremely cumbersome, with attendant drawbacks in terms of storage, maneuverability and undesirable stress on the grooming vehicle.

As snowboarding is a relatively recent sport, the garage/storage areas most conventional snow grooming vehicle are not configured to easily accommodate existing half pipe groomer attachments. This may result in either the need for new purpose-built storage facilities or the need to store the attachment separately from the vehicle.

ii. The attachment can often only be deployed and used on one side of vehicle. Thus, it is necessary to turn the vehicle around to groom both half pipe walls.

iii. The degree of curvature of the attachment cannot normally be altered.

It will be appreciated that the shaping/grooming provided by the half pipe attachment may also be employed to enhance jumps and other terrain features, and in such instances the desired degree of curvature may differ from that used for a half pipe side wall. In some instances, the desired shape of the groomed surface may be straight or concave, or some combination of shapes. It would therefore be desirable to be able to shape such a surface with a single attachment, in a single pass. When mowing undulating or inclined surfaces such as roadside cuttings or embankments, it would be equally desirable to be able to follow the exact contours of the surface to give a uniform cut.

DISCLOSURE OF INVENTION

The object of the present invention is to substantially ameliorate the aforesaid disadvantages by the provision of an improved embankment groomer/shaper/cutter arm assembly.

According to a first aspect, the present invention provides an adjustable arm assembly attachable at one end to a suitable vehicle and being capable of deployment-substantially orthogonally to the direction of movement of said vehicle; said arm being substantially elongated and including two or more articulately connected sections and one or more actuator means capable of changing the orientation at least two said sections with respect to each other.

However, many novel aspects of the present invention mentioned hereafter are equally applicable to an embodiment incorporating a substantially elongated longitudinally inflexible arm and wherein a lower or outer surface of said arm forms a working surface provided with at least one tool.

Preferably, the lower or outer surface of at least one said section forms a working surface provided with at least one tool adapted for interaction with a terrain surface.

Preferably, the lower or outer surface of two or more said sections forms a continuous working surface provided with at least one tool and the said working surface of each section can be longitudinal curved or straight in the vertical plane.

Preferably, two or more of said working surfaces are of different widths and/or lengths.

Preferably, the longitudinal curvature of the or each said working surface may be altered in the vertical plane by said actuators.

Preferably, the or each actuator means is capable of altering the angle between adjacent sections to coil the arm assembly for transport and/or storage and uncoil for use and said actuator means are attached between adjacent sections and between the said attached end of the arm and a vehicle mounting means.

Preferably, two or more tools on at least one working surface are inter-linked by a movable conveying means and/or one or more tools are positioned at fixed locations on at least one working surface.

Alternatively, two or more working surfaces are provided with separate conveying means and the or each said conveying means is/are movable by at least one drive.

Preferably, each conveying means is separately provided with at least one drive.

Preferably, at least one said conveying means is constrained to move within a closed path, constrained by a slotted track on said working surface with the or each tool projecting outwardly from said track.

Preferably, said conveying means passes around at least two direction-changing means, wherein at least one of said direction changing means is a drive.

Preferably, the said closed path is located substantially about the periphery of at least one working surface.

Preferably, said conveying means is capable of bi-directional movement along said closed path and is selected from the group including a chain, belt, rope, wire, or hawser.

Alternatively, at least one section is formed from two sub-units which may be pivoted with respect to each other about mutual pivot axis orthogonal to the direction of vehicle travel in use.

Preferably, portions of said closed path intermediate said direction changing means are substantially parallel and extend substantially along opposing longitudinal edges of said working surface and are preferably substantially parallel.

Preferably, the said portion of the closed path along one longitudinal edge of at least one working surface is vertically elevated with respect to the portion of the said path along the opposing longitudinal edge, wherein said elevation is optionally adjustable.

Preferably, the said vertical elevation is adjustable by means of pivoting the said arm assembly about a horizontal axis co-planar with the longitudinal axis of the elongated arm assembly.

Preferably, the said vertical elevation is adjustable by pivoting and/or height adjusting at least one of said direction changing means or by pivoting said sub-units about said mutual pivot axis.

Preferably, said tools are adapted for cutting, scraping/pushing, packing, smoothing and/or rolling a terrain surface, wherein said terrain surface includes snow, ice, sand, soil, mud, building debris, grass, crops, undergrowth, coal, particulate aggregates.

Preferably, the tools are selected from the group including a paddle, scraping element, rasping element, a cutter shaft, spiral cutter, brushing roller, pick-up roller and any combination of same. Said tools may optionally be are rotatably mounted.

Preferably, the said arm assembly is pivotably attachable to said vehicle about a vertical pivot point, enabling the or each section to be pivoted for deployment on either side of the said vehicle and may be moved in the vertically plane.

Preferably, the said arm assembly may be moved transversely to the direction of movement of the vehicle and may be at least partially rotated about an axis in the horizontally plane.

Preferably, one or more supporting devices are located at predetermined fixed positions about one or more working surface(s) including the longitudinal edges of said working surface and between said opposed portions of said closed path intermediate said direction changing means.

Optionally, two of said supporting devices are laterally offset with respect to each other and/or at least one supporting device is located at the intersection of adjacent working surfaces.

Preferably, one or more said supporting devices are formed as a said tool.

Preferably, one or more said supporting devices are configured to contact the terrain surface in use and thereby provide support by transferring at least a portion of the arm assembly weight to the terrain surface.

Preferably, at least one section is independently pivotable with respect to an adjacent section about an axis orthogonal to the direction of movement of the arm assembly when deployed in use.

Preferably, one or more flexible grooming elements may be affixed to the longitudinal edge of one or more working surface facing away from the direction of movement of the said vehicle, configured such that a trailing edge of the or each grooming element is wiped across the adjacent surface of the terrain when in use. Optionally, said flexible grooming elements are detachable.

Preferably, the said flexible grooming elements are movable between said in-use position and a stand-by position whereby said grooming elements are retained out of contact with the terrain surface.

Preferably, said grooming elements are located along both said opposing longitudinal sides of said working surface.

Preferably, said tools are hinged to move freely in one direction along the longitudinal axis of the section, but to be fixed in the reciprocal direction.

Preferably, said tools are hinged to move freely in one direction orthogonal to the longitudinal axis of the section, but to be fixed in the reciprocal direction.

Preferably, said arm assembly is integrally attached to said vehicle

BRIEF DESCRIPTION OF DRAWINGS

By way of example only, preferred embodiments of the present invention are described in detail with reference to the accompanying drawings, in which.

BEST MODE FOR CARRYING OUT THE INVENTION

FIG. 1–6 show a first embodiment of the present invention (1) of an adjustable arm assembly (2) in the particular form of a half pipe snow groomer/shaper attachment. It will be appreciated that whilst this embodiment refers to an attachment specifically for use with snow, the salient aspects of the present invention may be employed in other areas such as earth moving, excavation and construction related applications. Moreover, whilst the preferred embodiment is shown as an attachment which may be affixed to a conventional snow grooming vehicle, the present invention is equally applicable as an integrated feature of a purpose built vehicle.

Figure 1:
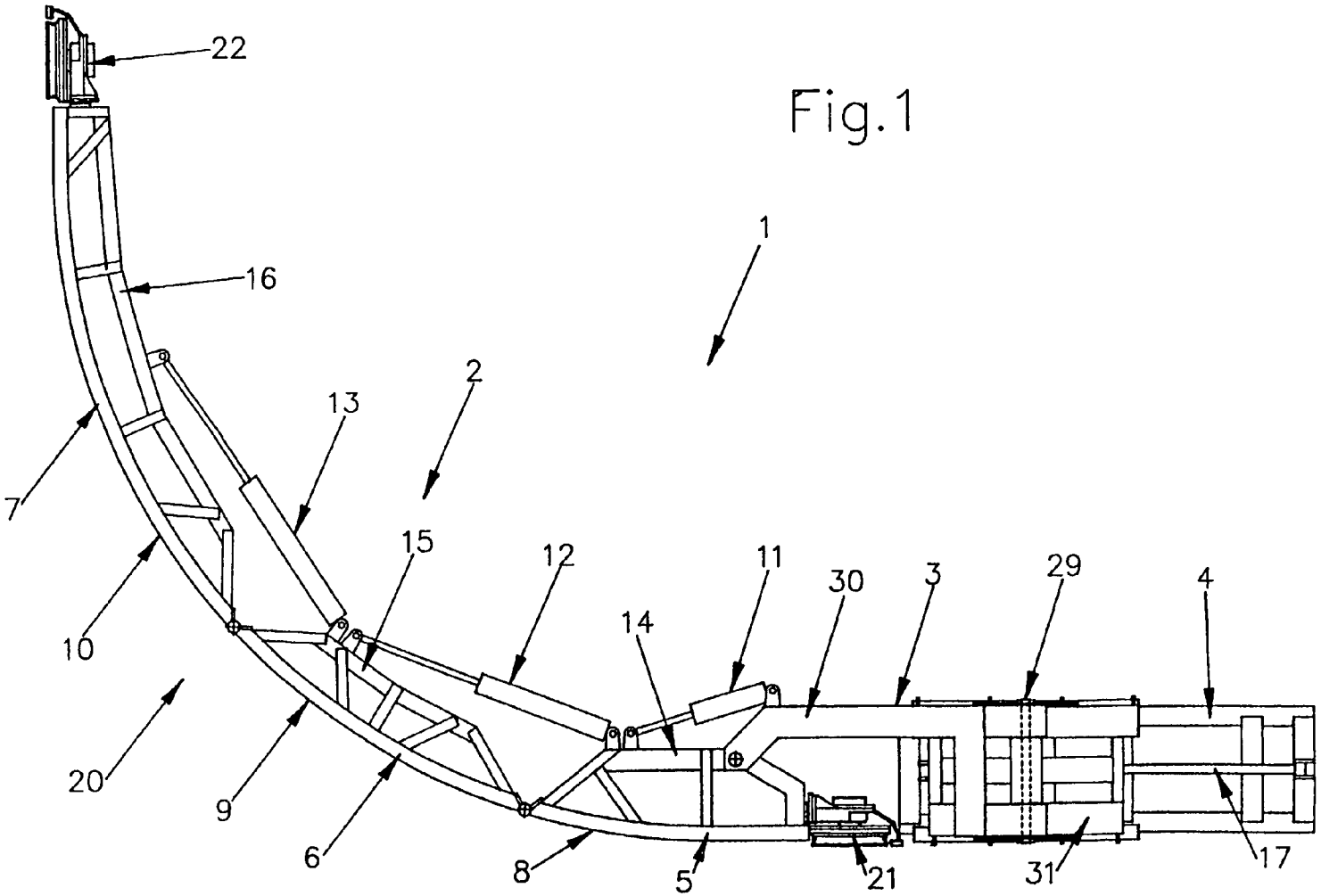
FIG. 1. shows a side elevation of a first embodiment of present invention deployed for use, FIG. 2. shows a side elevation of the first embodiment shown in FIG. 1, with the present invention retracted for storage and/or transport, FIG. 3. shows front and side elevations of a cutter, roller and scraper tools, FIG. 4. shows a cross-sectional view through the line XY shown on FIG. 2, FIG. 5. shows an enlarged side elevation view of the embodiment shown in FIG. 1, FIG. 6. shows a semi-schematic plan view from below of the working surface of the arm assembly, FIG. 7. shows a schematic front or rear elevation of a second embodiment, with the arm assembly deployed for use, FIG. 8. shows a schematic front or rear elevation of a second embodiment as shown in FIG. 7, with the arm assembly deployed in a different position, FIG. 9. shows a selection of plan views labelled a)–e) of the different configurations of the arm assembly, FIG. 10. shows a side elevation of a third embodiment, with the present invention retracted for storage and/or transport, FIG. 11. shows a side elevation of the embodiment shown in FIG. 10 deployed for use, FIG. 12. shows a plan view from above of a portion of the arm assembly of the third embodiment, FIG. 13. shows a sectional view along the line AA shown in FIGS. 10 and 12, and FIG. 14. shows a side elevation of a forth embodiment of a non-flexible arm assembly.

FIG. 1 shows the half pipe shaper attachment in its deployed state (i.e. ready for use) with the grooming vehicle omitted for the sake of clarity and consisting generally of an elongated arm assembly (2), a vehicle mounting means in the form of mounting assembly (3), and slide carriage (4).

The arm assembly (2) consists of three elongated sections (5, 6, 7) respectively, articulately connected together to form a single elongated arm, pivotally attached at one end (via section (5)) about a vertical axis (29) (shown in FIG. 5) to the mounting assembly (3). Section (5) is also connected to the midsection (6) which in turn is connected to the end section (7). The three sections (5, 6, 7) are each configured with a transversely planar, longitudinally curved (in the vertical plane) working surfaces (8, 9, 10) respectively, which collectively constitute a combined elongated outer working surface (20) designed for interaction with the terrain surface in use. The two longitudinal edges of the working surface (20) are substantially parallel, joining at either end of the arm (2) in semi circular end sections. During use and/or storage/transport, the shaping surface (20) is orientated substantially parallel to, or at a slight angle to, the surface of the snow/ground.

When the arm assembly (2) is fully extended for use in grooming a half pipe wall, the outer working surfaces (8, 9, 10) form a smooth continuous convex arc in the vertical plane. The movement of the sections (5, 6, 7) is controlled by actuators (11, 12, 13) respectively, attached between the mounting assembly (3) and section (5), sections (5) and (6), and sections (6) and (7) respectively. The mounting points for the actuators (11, 12, 13) on the sections (5, 6, 7) are respectively positioned on support framework assemblies (14, 15, 16) located on the opposing side to the outer working surfaces (8, 9, 10) respectively.

Figure 2:
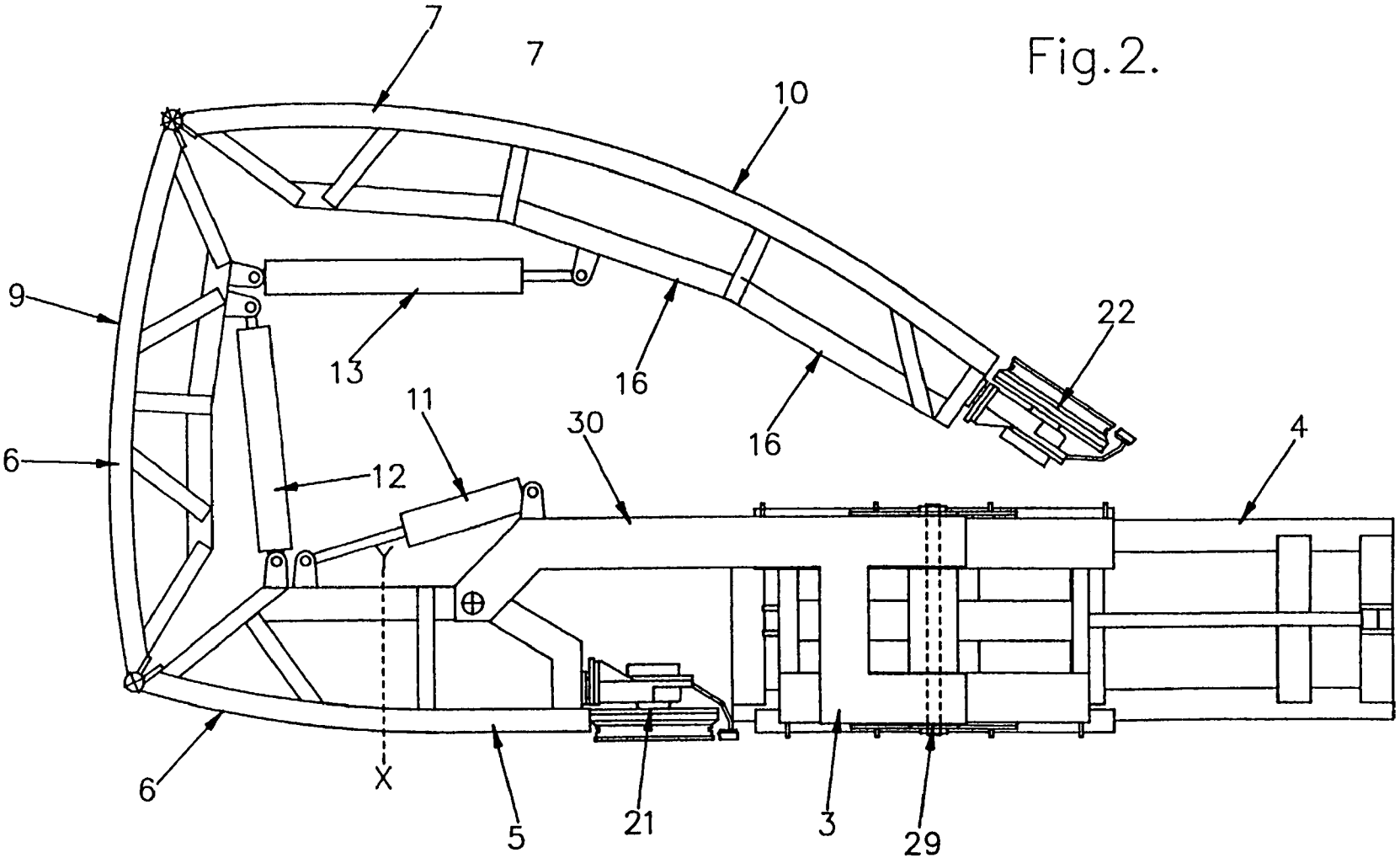

In this embodiment, the actuators (11, 12, 13) are double-acting (i.e. two-way) hydraulic rams, though any suitable actuation means may be employed. Extending the actuators (11, 12, 13) to their maximum extent orientates the three sections (5, 6, 7) in a smooth continuous curve (in the vertical plane) corresponding to the optimum side wall profile for a snowboard half pipe. As shown in FIG. 2, after use, the actuators (11, 12, 13) are retracted, thereby pulling the sections (5, 6, 7) closer towards each other and towards the mounting assembly (3) in a coiling action. This retraction or coiling of the arm (2) greatly reduces the degree of lateral projection of the arm (2) beyond the sides of the vehicle and thus mitigates against the need for specialised enlarged garaging/storage facilities to accommodate a non-retractable arm assembly.

The lateral projection of the arm assembly (2) can be further varied by the operation of an additional actuator (17) located between the vehicle mounting assembly (3) and the slide carriage (4). Typically, the slide carriage (4) would be securely mounted on the grooming vehicle's conventional grooming blade mounting point, as this provides the feature of vertical movement and a lateral tilting motion of any attached item. In use, the actuator (17) is used to extend the arm assembly (2) further away from the vehicle to provide the maximum clearance between the shaping action of the arm (2) and any interference by the tracks of the vehicle. During storage and/or transport, the actuator (17) is retracted to pull the arm assembly (2) across the width of the vehicle to minimise the extent of any lateral projection.

It will be appreciated that the arm assembly (2) need not be restricted to three curved sections (5, 6, 7). Alternative embodiments may configured with a variety of section numbers and sizes as described in more detail hereafter each with a curved or non-curved side profile dependent on the specific needs of application.

Whilst it is conceivable to utilise a variety of snow cutting/moving/shaping techniques in conjunction with the aforesaid arm assembly (2) configuration, the following arrangement has been found to be particularly suitable for use with an articulated arm.

Figure 6:
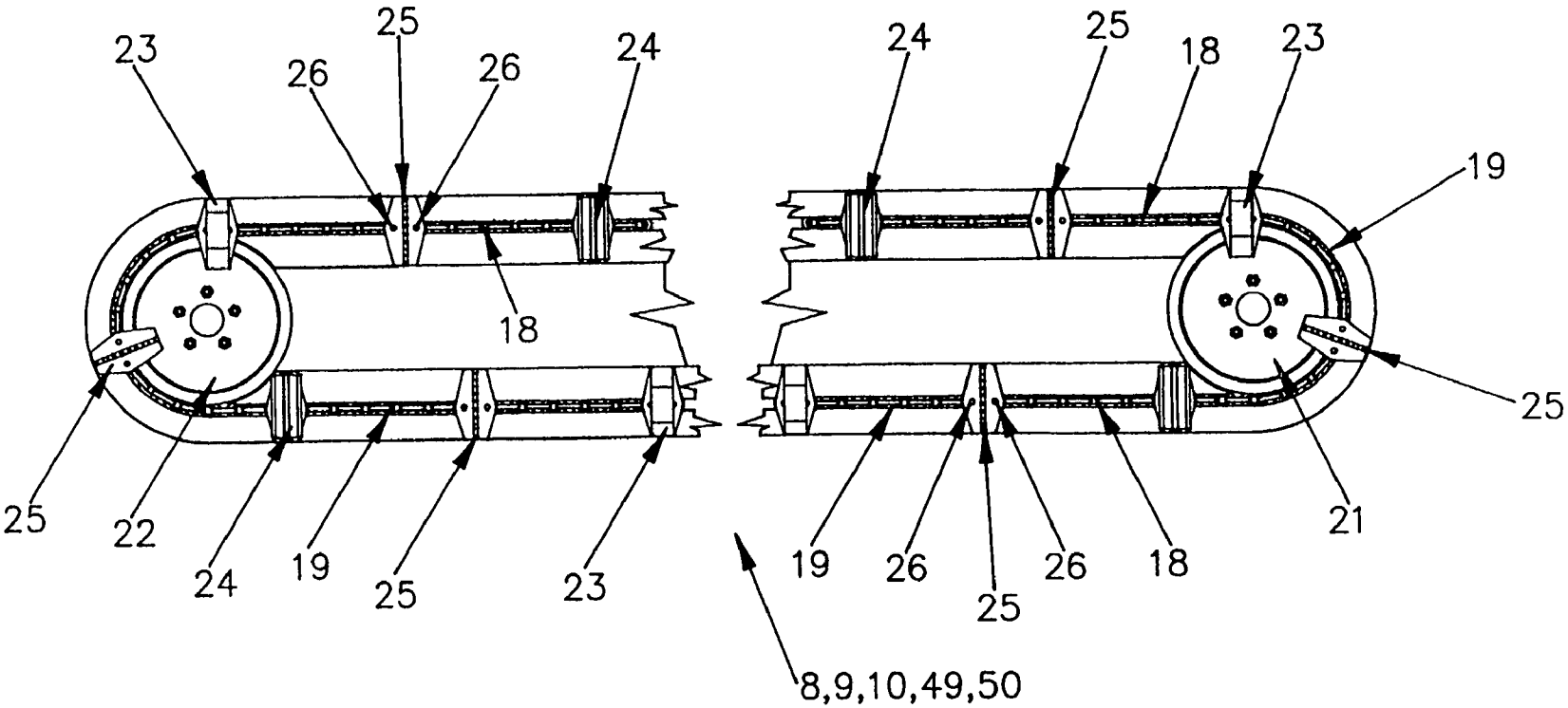

To provide the grooming and shaping action required to produce and maintain a half pipe wall, the working surface (20) is provided with a plurality of tools of various types. The tools are releasably attached to a movable conveying means constrained within a continuous closed path formed by track (18) extending around the periphery of the shaping surface (20). In this embodiment, the conveying means is formed by a continuous chain (19) extending around the track (18), engaging with at least one drive means as shown in plan view from below in FIG. 6 and in a cross-sectional view (through section (5)) in FIG. 4. To aid understanding and clarity, FIG. 6 is semi-schematic rather than a true scale view and is generic to each of the illustrated embodiments.

In the embodiment shown in FIGS. 1–6, two drive means in the form of two motors (21, 22) are located at the attached and the free end of the shaper arm (2) respectively. Each motor (21, 22) is provided with a rubber coated drive wheel which provides the fictional engagement to drive the chain (19) around the track (18) after the chain (19) has been tensioned to the desired degree. When the motors (21, 22) are rotating during operation, the chain (19) follows a continuous closed path along one of the longitudinal edges of the working surface (20), around one of the motor drive wheels (21, 22), along the opposite longitudinal edge (moving in the opposite direction to the chain (19) on the other longitudinal edge) and then around the other motor drive wheel (21, 22). The motors (21, 22) together with the chain (19) and tools may be rotated in both possible directions.

The tools (shown individually in more detail in FIG. 3) in this embodiment consist of a cutter (23), a roller (24) and a pusher/scraper (25) shown in both front (FIGS. 3*a, c*, & *e*) and side (FIGS. 3*b, d* & *f*) elevations respectively. The cutter (23) is a simple hoop (with optional webs supporting the hoop) of a constant cross-section with the open faces of the hoop being perpendicular to the direction of the chain (19) movement. As both open sides of the cutter (23) are symmetrical, the cutter may operate in either direction of chain (19) movement. Similarly, the roller (24), comprised of a corrugated rolling wheel rotatable in the direction of the chain (19) travel, is also capable of bi-directional movement. The scraper (25), equally operable in both directions of travel, consists of a simple planar blade with a serrated/jagged edge, orientated perpendicularly to the direction of chain (19) movement. In use, the snow cut free from the snow surface by cutter (23) is pushed up or down (depending on the direction of the chain (19) movement) the wall of the half pipe by scraper (25) whilst the roller (24) packs and consolidates any remaining loose snow on the half pipe surface.

Figure 5:
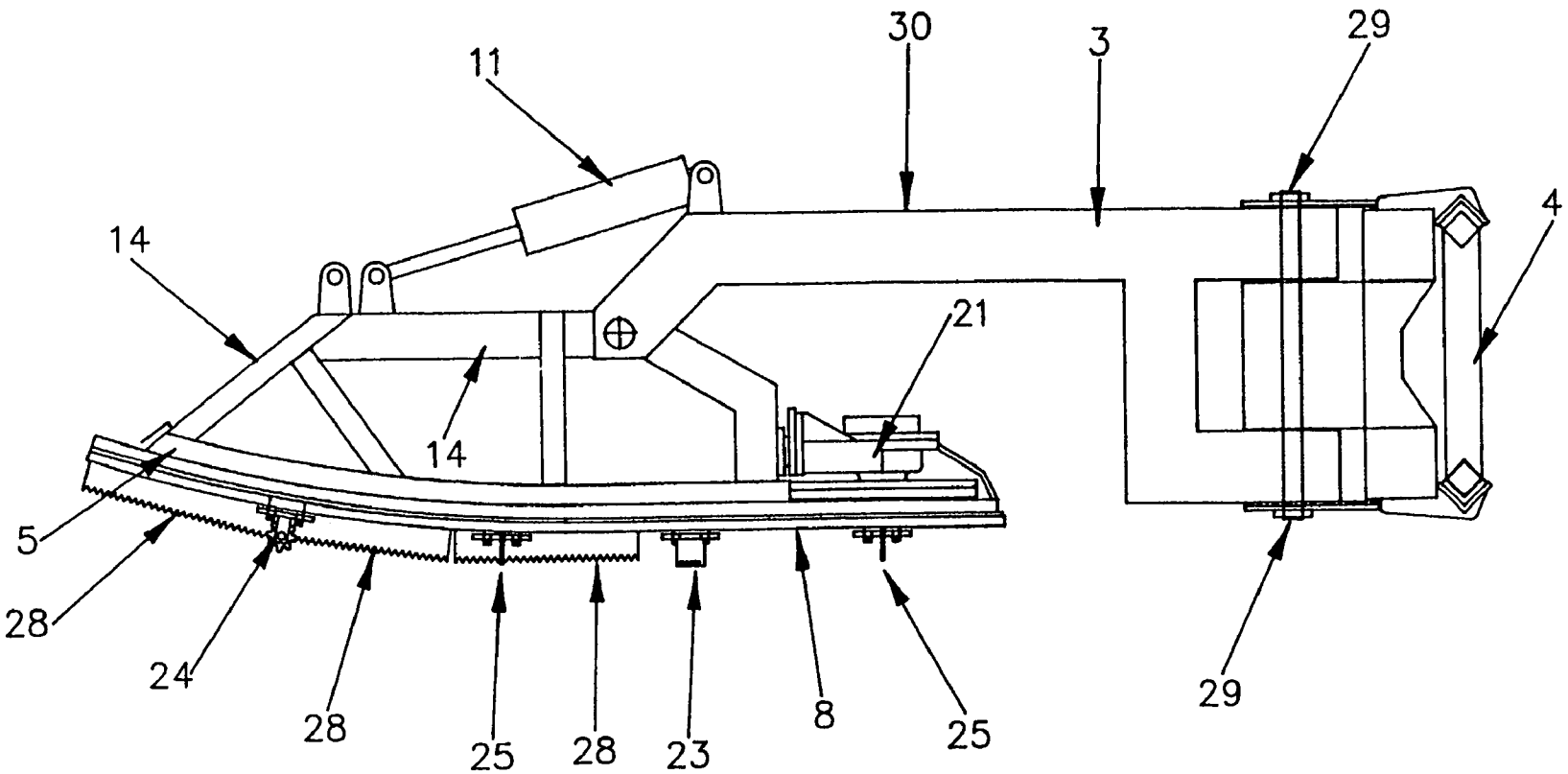

As shown in FIG. 5, the three tools (23, 24, 25) are normally arranged in a cutter (23), scraper (25), roller (24), scraper (25), sequence at recurring equidistant intervals along the chain (19), though naturally, different permutations are possible. The tools (23, 24, 25) are attached to the chain (19) by means of two small cylindrical blocks (26) each welded to a separate link of the chain (19) and secured by a pin (27) through a portion of each block passing through an aperture in the base-plate of the respective tools (23, 24, 25). The use of two blocks (26) at spaced points on the chain (19) to attach each tool (23, 24, 25) enhances the tools resistance to twisting moments, thus aiding mechanical reliability and longevity of the arm assembly (2) in use.

A plurality of detachable wiper elements (28) are attached along the full-length (for clarity, only three wiper elements are shown in FIG. 5) of the rearward (in relation to the direction of the vehicle movement) longitudinal edge of the working surface (20). When the working surface (20) is in use (i.e. in close proximity to the wall of the half pipe), the wiper elements (28) are wiped across the surface of snow to give the final degree of finishing to the snow surface. The wiper elements (28) typically incorporate a serrated trailing edge to give a slightly corrugated or corduroy effect to the surface of snow. Depending on the direction of travel of the arm assembly (2), the wiper elements (28) may be removed from one longitudinal edge and reattached to the appropriate longitudinal edge of the working surface (20). In an alternative embodiment, wiper elements may be hinged to both the longitudinal edges of the working surface (20), with the wiper elements of the leading longitudinal edge being hinged upwards out of contact with the snow during use—either manually or automatically.

A further advantageous feature of the present invention is that the whole arm assembly (2) is pivotably attached about a vertical axis (29) to enable the arm assembly (2) to pivot through substantially 180° to groom/shape the walls of the half pipe on the left or right hand sides of the vehicle. This is achieved by a configuration of the mounting assembly (3) including a connecting bracket (30) and a support framework (31). The connecting bracket (30) provides both the aforementioned horizontally pivotal connection to section (5) of the arm assembly (2) and the vertically pivotal connection to the support framework (31) about the said axis (29). FIG. 5 shows the arm assembly (2) orientated perpendicularly to the slide carriage (4) at the midway point between its operating position on the left or right-hand side of the vehicle. A releasable securing means such as a retaining pin may used to secure the connecting bracket (30) against the support framework (31) (on the left or right-hand side as appropriate) during operational use to prevent any unwanted movement of the arm assembly (2) about the vertical axis (29).

As the tools (23, 24, 25) travel along the longitudinal edges of the working surface (20) in opposite directions, it would normally be counter-productive if the working surface (20) was exactly parallel to the half pipe wall as snow would be simultaneously moved/scraped upwards and downwards. Thus, the arm assembly (2) is rotated slightly (via a tilting movement of the conventional grooming blade mounting) about its horizontal longitudinal axis (i.e. orthogonal to the direction of the vehicle travel) such that only one of the longitudinal edges (together with the adjacent tools) is in contact with snow during use. The shaping arm (2) is normally rotated so that the trailing longitudinal edge is closest to the snow so that the wiper elements (28) may provide the above described finishing effect to the snow. However, different finishing surfaces are possible by altering the degree of rotation of the arm assembly (2) and/or reversing the movement direction of the tools (23, 24, 25). Tilting the whole arm assembly (2) in this manner to raise one of the said longitudinal edges is the most expedient means in most applications. However, alternative means of achieving this effect are possible and are explored in more detail later.

It will be apparent that the invention as hereinbefore described may be readily attached to the front or rear of a suitable vehicle as stated earlier. It would also be possible to deploy the arm assembly (2) from the side of a suitable vehicle, though pivoting the arm assembly (2) for use on the opposing side of the vehicle would be more difficult.

Although efficient grooming the walls of a conventional half pipe is an important activity for many ski field operators, it would also be advantageous if the same grooming device could be applied to different terrain features. These could include man-made features such as jumps, kickers, table-tops, spines, quarter pipes, rollers and a variety of natural terrain features. To achieve this end, the arm assembly (2) is configured in a second embodiment to be able to achieve differing longitudinal curvature profiles (in the vertical plane) to suit the specific application required and may be implemented in a number of ways as described further herein.

Figure 7:
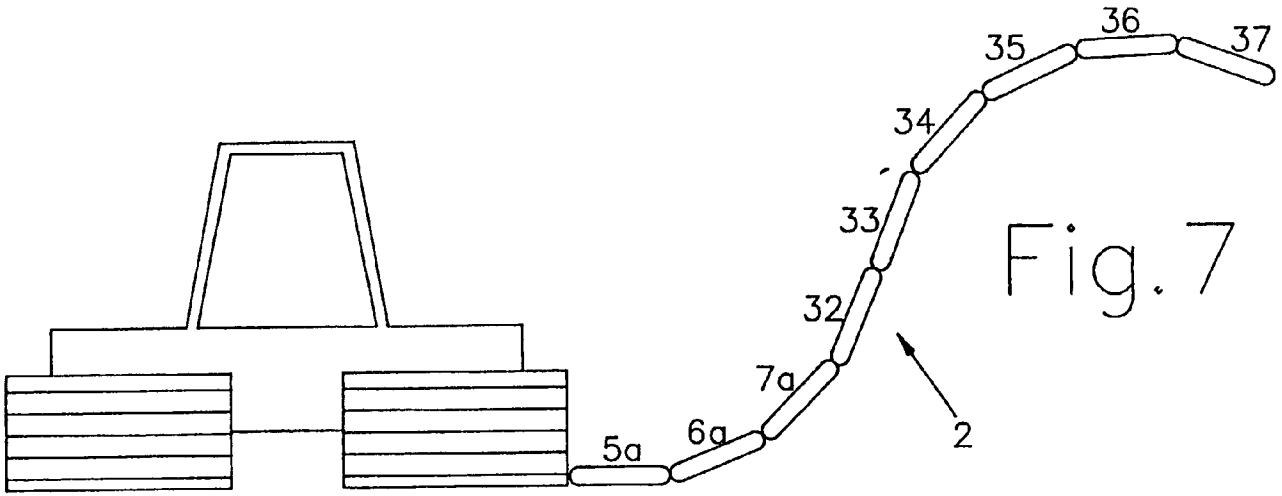
Figure 8:
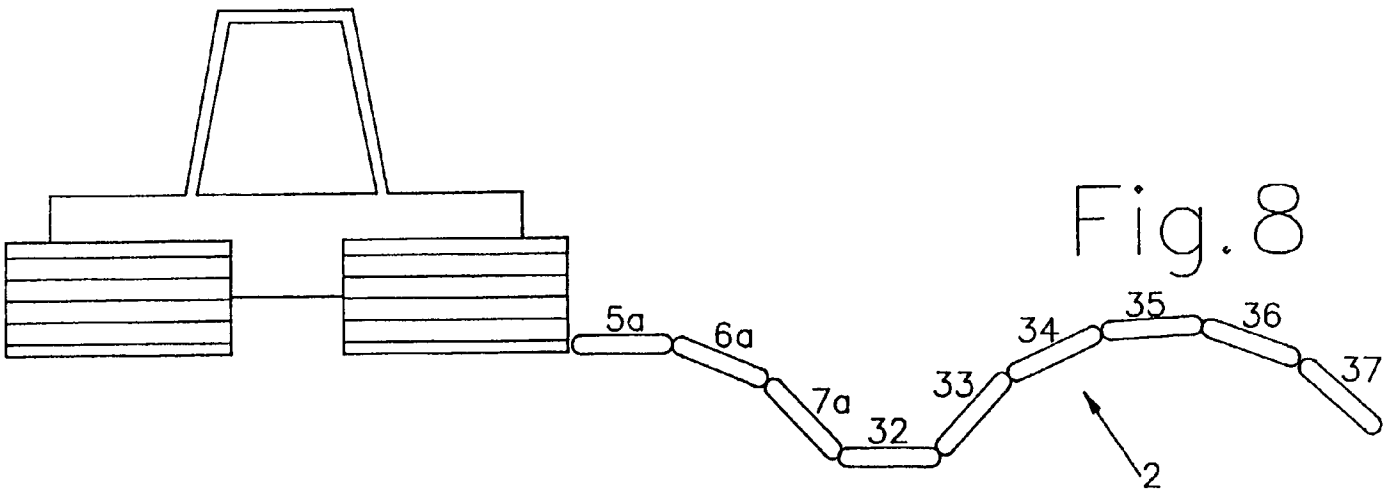

FIGS. 7 and 8 show front or rear elevation views of a second embodiment in a simplified diagrammatic form wherein the assembly arm (2) is composed of a plurality of sections (5*a*, 6*a*, 7*a*, 32, 33, 34, 35, 36, 37) which are articulately connected together such that adjacent sections may pivot upwards or downwards (in the vertical plane) with respect to each other to form, convex or concave longitudinal curves (or combinations of same) and/or planar alignments of two or more sections.

Drives/actuators providing such independent pivoting actions between adjacent sections together with any associated support framework assemblies of each section are omitted from FIGS. 7 and 8 for the sake of clarity, though these can operate in a directly comparable manner to the corresponding elements of the first preferred embodiment. Similarly, the conveying means and associated tools described in the first embodiment and shown in FIG. 6 can also be utilized on one or the sections of the second embodiment. The sections (5*a*, 6*a*, 7*a*, 32, 33, 34, 35, 36, 37) of the second embodiment differ from those of the first embodiment not only in number and size, but are each formed with a planar (i.e. non-curved) lower working surface. Consequently, one or more planar arrangements of two or more sections are readily formed, enabling the shaping of precisely angled edges to various planar terrain features.

The formation of convex and/or concave shapes are, by virtue of the planar nature of each section, formed as composite curves composed of short straight sections. Naturally, the shorter the longitudinal length of each section and the greater number thereof, the closer the groomed terrain surface will approximate to a true curve. FIG. 7 shows the sections (5, 6, 7, 32, 33) adjacent the grooming vehicle arranged in a convex curve, all the remaining sections (34, 35, 36, 37) forming a concave curve. FIG. 8 shows a further example of the myriad possible arrangements of the sections (5, 6, 7, 32, 33, 34, 35, 36, 37) of this embodiment.

In addition to the aforesaid pivoting of adjacent sections in the longitudinal direction of the arm assembly (2), configuring two or more sections to pivot in the lateral direction of said arm assembly (2) would permit the working surface to match the local contours of the terrain surface. In addition to snow grooming applications, this would be particularly advantageous in applications such as grass cutting to or similar. It can be readily seen therefore that such an arm assembly (2) of could be adapted to form/groom a wide range terrain features on ski fields, or closely match and follow the undulations of an existing terrain surface.

Figure 9:
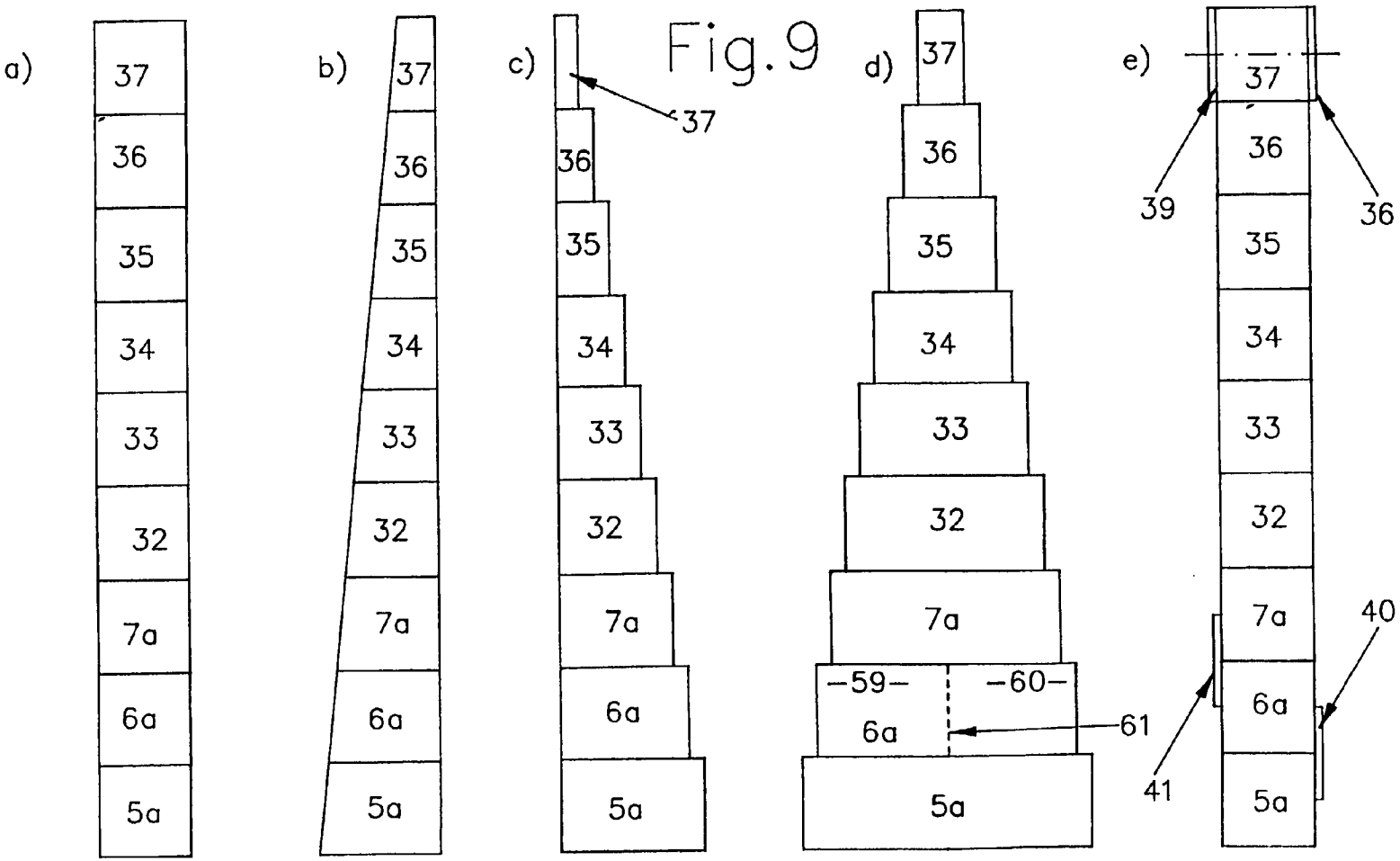

Further variants of this embodiment are achieved by employing sections of different widths and/or lengths which may be arranged in a variety of configurations as illustrated in plan view in FIGS. 9*a*)–9*e*). FIG. 9*a*) shows each section with equal width and length. In FIG. 9*b*) and *c*), one of the longitudinal edges of each sections (5*a*, 6*a*, 7*a*, 32, 33, 34, 35, 36, 37) remains aligned orthogonal to the direction of vehicle travel, whilst the width of each section (5, 6, 7, 32, 33, 34, 35, 36, 37) successively tapers from section (5) attached to the vehicle. The opposing longitudinal edge forms either an oblique straight line (FIG. 9*b*)) or a stepped configuration (FIG. 9*c*)). FIG. 9*d*) employs a corresponding stepped configuration to both longitudinal edges to reduce the width of each section extending away from the vehicle.

The FIG. 9*e*) shows a comparable section arrangement to FIG. 9*a*), with the addition of a plurality of supporting devices (38, 39, 40, 41) located about the longitudinal edges of the arm assembly (2), though these can also be located on any convenient point on the working surface of a section which does not hinder the movement of the tools attached to the conveying means during operation.

The supporting devices (38, 39, 40, 41) can fulfill a variety of functions, including, in part, providing a means of transferring a portion of the weight of the arm assembly (2) from the vehicle to the terrain surface. To effect such a role, the supporting devices can take the form of rollers or rotatable drums which come into direct free wheeling or powered contact with the terrain surface in use. Additional and/or alternative roles of the supporting devices include acting as additional tools for the grooming/scraping or suchlike of the terrain surface.

The supporting devices may be located in lateral alignment on opposing longitudinal sides of arm assembly (2) (as shown by the supporting devices (38, 39) located on the outermost section (37)) or be laterally offset with respect each other and/or be centered on the intersection between adjacent sections as shown by supporting devices (40, 41). Support devices in the form of the flexible finishing tools (28) located between the intersection of adjacent sections can be used to a smooth out the apices formed by the polygonal profile of a plurality of planar sections (5, 6, 7, 32, 33, 34, 35, 36, 37).

A variety of different tools may be simultaneously used in the positions of the supporting devices (38, 39, 40, 41) to achieve various effects; e.g. using a clearing tool such as a worm/spiral drive on the forward (relative to the direction of motion) longitudinal edge of the arm assembly (2) to remove material (e.g. sand or snow), whilst using smoothing support devices on the opposing 'rearward' longitudinal edge.

When engaged in mowing, clearing undergrowth, or other suchlike activities where it is not necessarily important to transport material up or down the working surface of the arm assembly (2), the movable conveying means need not be employed. Instead, cutting, stripping, flattening or rolling tools may be used as said support devices located in any convenient fixed position. This may be used in combination with said weight bearing/transfer support devices (38, 39, 40, 41) to provide a means of maintaining the cutting blades at a fixed distance above the terrain surface.

In a third embodiment shown in FIGS. 10–13, an adaptation of the first embodiment is thereshown which permits the longitudinal curvature of one or more working surface (20) to be adjusted. Instead of relying upon a large number of individual sections to form different degrees of curvature of the arm assembly (2) (as per the second embodiment), the third embodiment groups a plurality of sections (42, 43, 44) and (45, 46, 47, 48) to form common longitudinally flexible working surfaces (49) and (50) respectively. It will be seen from FIGS. 10 and 11 (respectively showing the assembly arm in a coiled transport/storage position and deployed for use) that the third embodiment displays a strong visual similarity to the above described first embodiment, and many components (numbered likewise) are identical.

Figure 3:
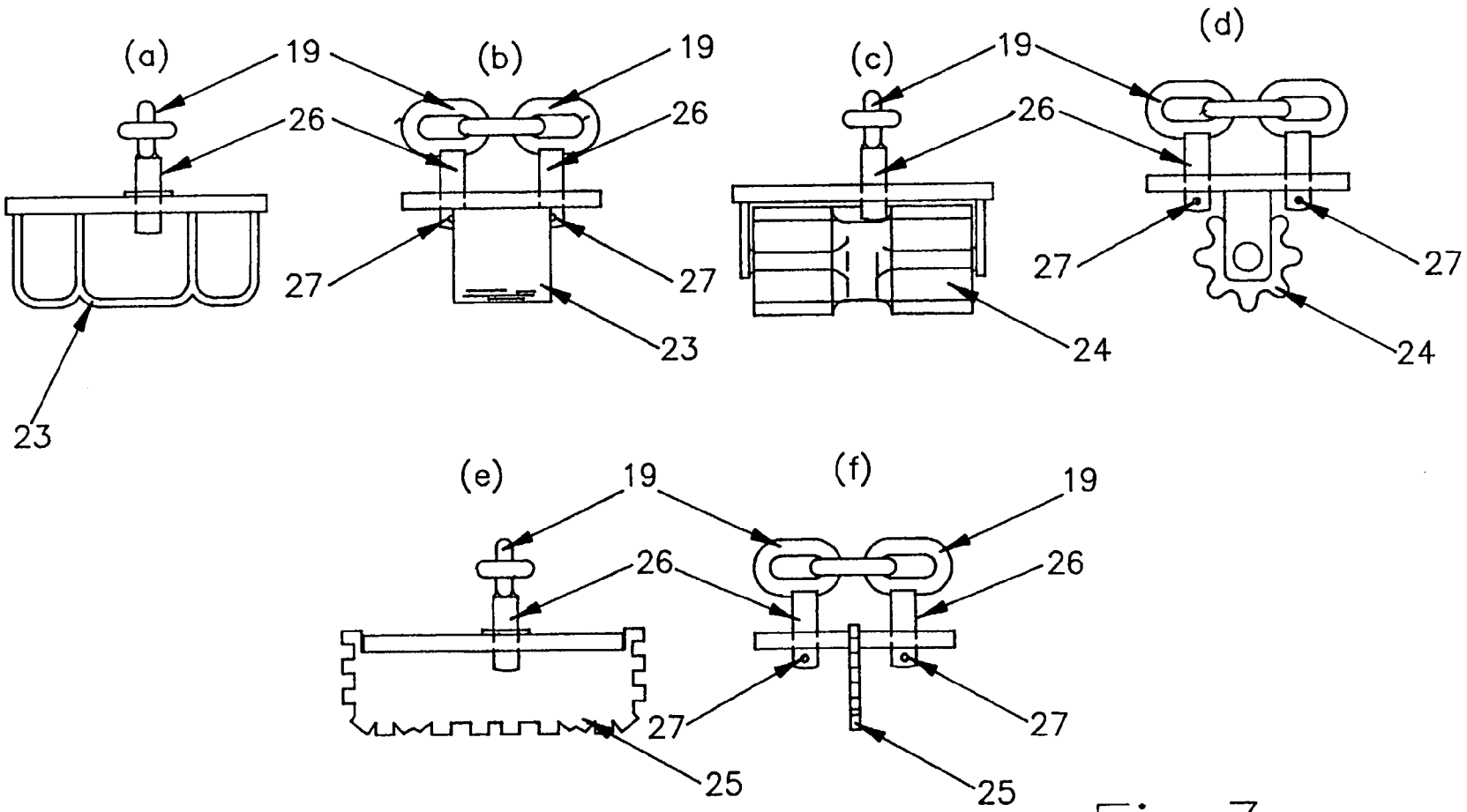
Figure 4:
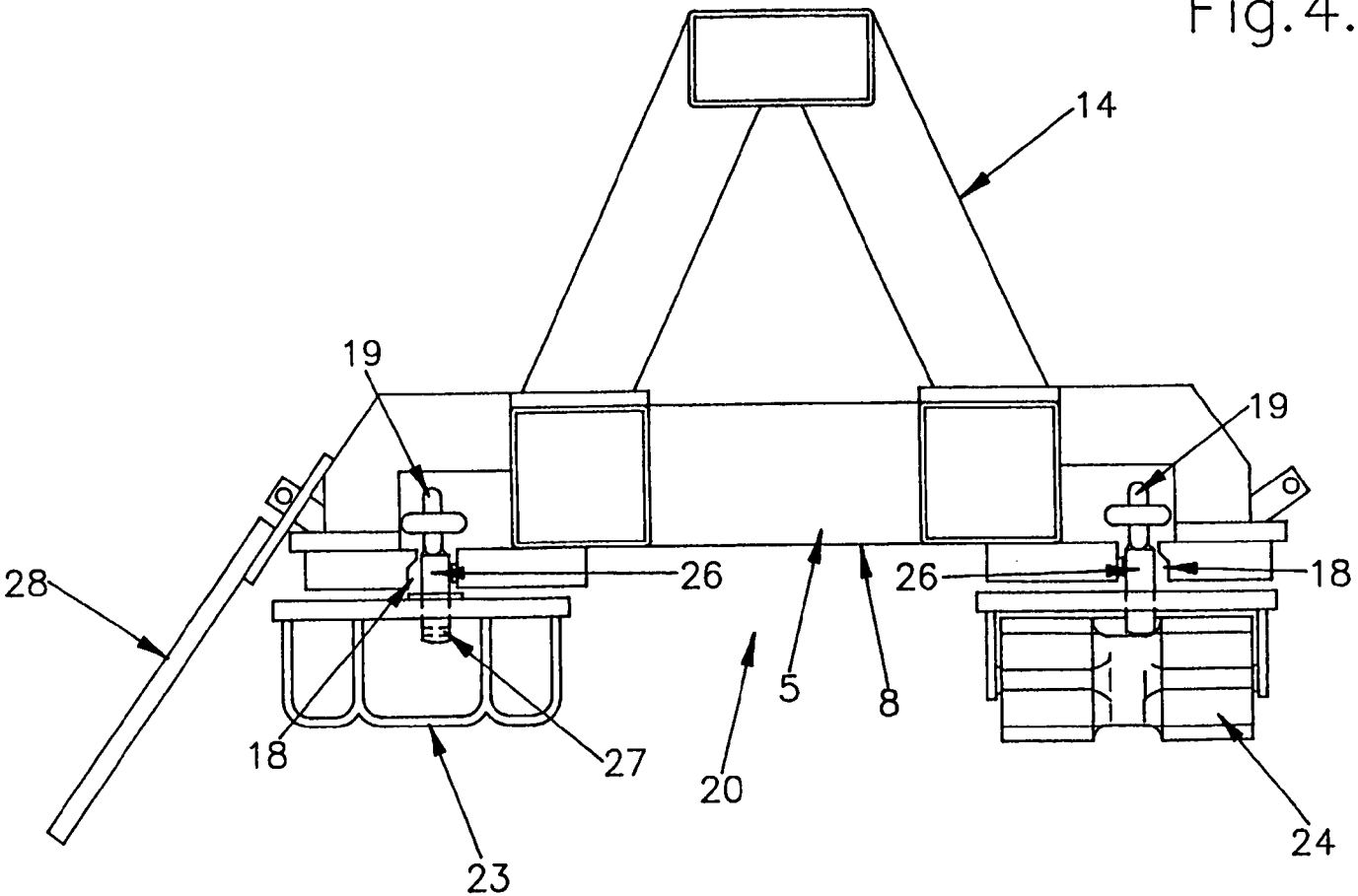

Upon superficial inspection, it might appear that the third embodiment is also comprised of three main sections (equivalent to sections (5, 6, 7)) as per the first embodiment. Indeed, the section (5) attached to the vehicle via mounting assembly (3) is common to both the first and third embodiment and the conveying means and associated tools described with reference to the first embodiment (as shown in FIGS. 3 and 6) can also be utilized on one or more of the sections/working surfaces of the third embodiment. However, a subtle, though crucial distinction should be appreciated in that the working surfaces (49, 50) of the two outermost framework assemblies do not correspond to solely to two individual sections (i.e. sections (6) and (7) of the first embodiment) but are in fact two separate working surfaces (49, 50) common to two groups of individual sections (42, 43, 44) and (45, 46, 47, 48) respectively.

The centre working surface (49) common to three sections (42, 43, 44) is intermediate the working surfaces (8) of the section (5) attached to the vehicle mounting assembly (3) and that of working surface (50) at the free end of the arm assembly (2). Similarly, the adjacent working surface (50) at the free end of the arm assembly (2) is common to a plurality of (four) sections (45, 46, 47, 48). The working surface (8) adjacent to the vehicle could equally be configured with multiple associated sections, though this is not essential for explanatory purposes, nor for practical considerations in this particular embodiment.

Figure 12:
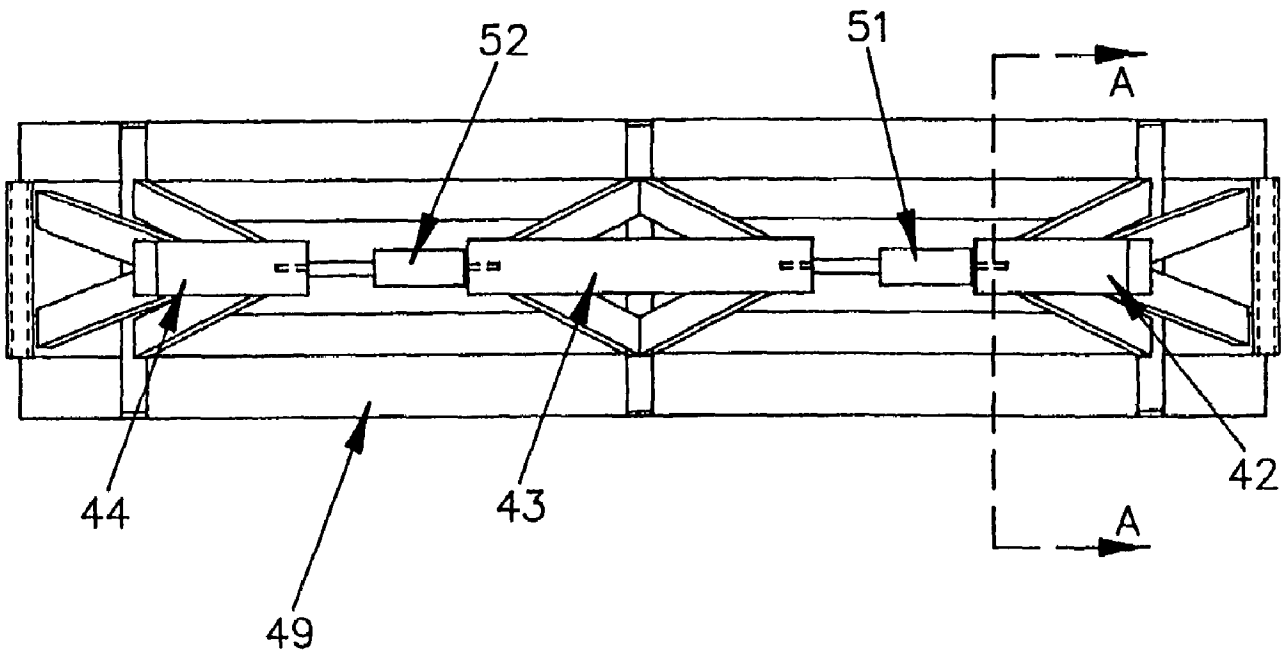

Considering the centre working surface (49) (and corresponding sections (42, 43, 44)) to illustrate the principles of operation, two symmetrical sections (42, 44) are fixedly attached to the working surface (49) at each longitudinal end thereof and are interposed by a centre section (43) pivotally attached to said working surface (49). The centre section (43) is also pivotally attached to both ends sections (42, 44) via drive/actuator means (51, 52) respectively. The actuators (51, 52) both operate in a direction substantially parallel to, but spaced apart from, the adjacent portion of the working surface (49). FIG. 12 shows a plan view (from above) of sections (42, 43, 44) located above the working surface (49).

As the working surface (49) is longitudinally flexible though inextensible, any alteration in the separation between end sections of (42, 44)—due to the expansion or contraction of actuators (51, 52) acting therebetween, causes the working surface (49) to flex outwardly or inwardly accordingly. A separate actuator (53) located between a support framework (14) on section (5) and section (44) enables the angle of the whole working surface (49) and associated sections (42, 43, 44) to be varied regardless of the specific curvature of the working surface (49).

A further actuator (54) operating between the section (44) and adjacent section (45) of the adjacent working surface (50) enables a corresponding movement of the outermost working surface (50). Sections (45, 48) located adjacent section (44) and the free end of the arm assembly (2) respectively, are fixedly attached to the working surface (50). Section (45) is pivotally attached via a actuator (55) to an adjacent section (46) which is also pivotally attached to an adjacent section (47) via the actuator (56) which is itself pivotally attached to the end section (48) via actuator (57).

Sections (46 and 47) are also both pivotally attached to longitudinally spaced positions on the working surface (50). Again, in a complimentary manner to above, actuators (55, 56, 57) all act in a direction substantially parallel to, though spaced apart from, the plane of the adjacent portion of the working surface (50).

The curvature of the working surface (50) is adjusted in an identical manner to that of working surface (49) by varying the separation between adjacent sections (45, 46, 47, 48) by means of one or more of actuators (55, 56, 57). Extending all the said actuators (11, 51, 52, 53, 54, 55, 56, 57) of the arm assembly (2) from their fully retracted state in the coiled transport/storage position of the arm assembly (2) shown in FIG. 10 extends the working surfaces (49, 50) outwards to form a concave curve as shown in FIG. 11. It will be seen that the shape of both flexible working surfaces (49, 50) are the complete opposite (i.e. concave rather than convex) to that used in grooming the walls of a half pipe, as per the first embodiment shown in FIG. 1.

Figure 10:
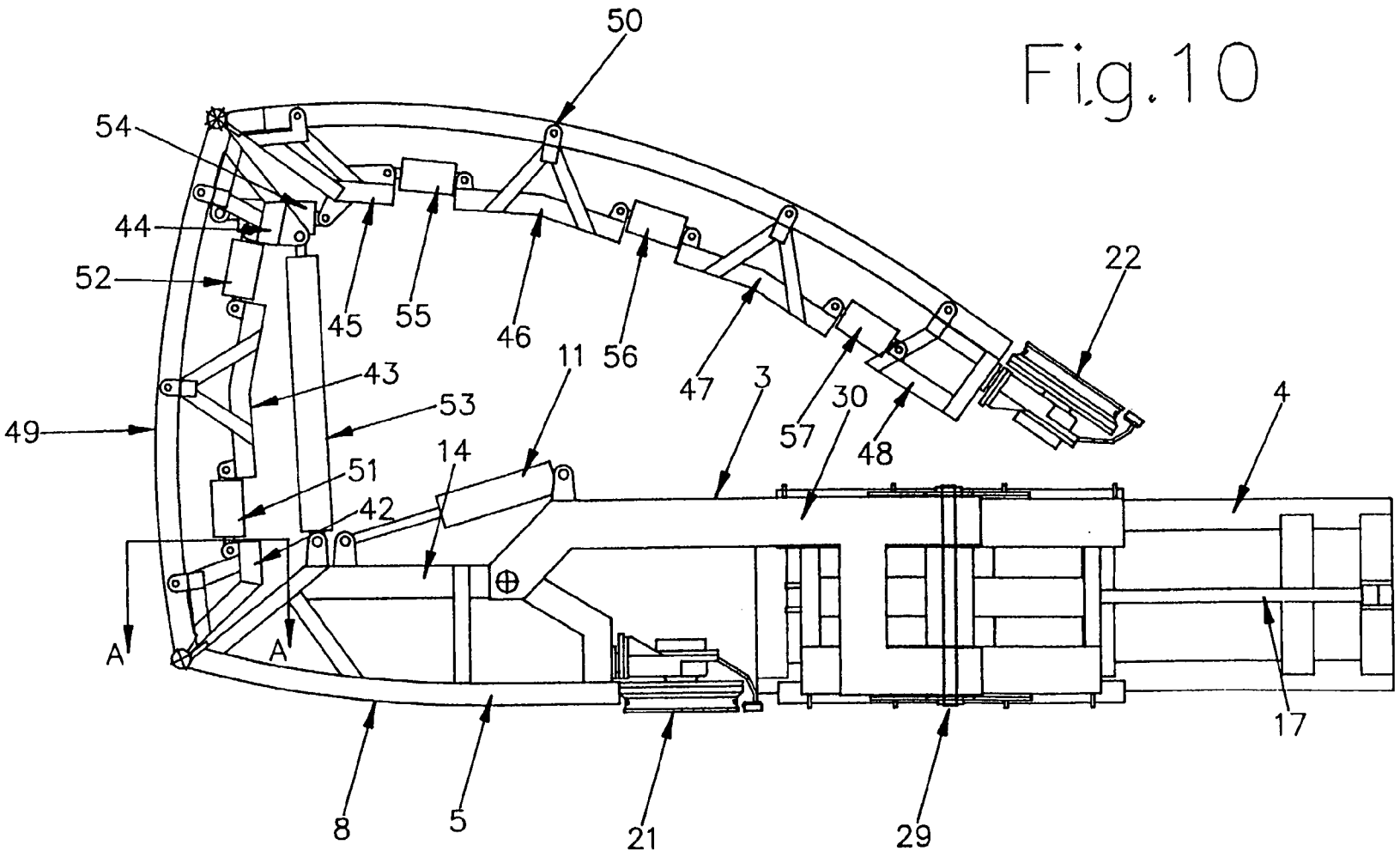
Figure 11:
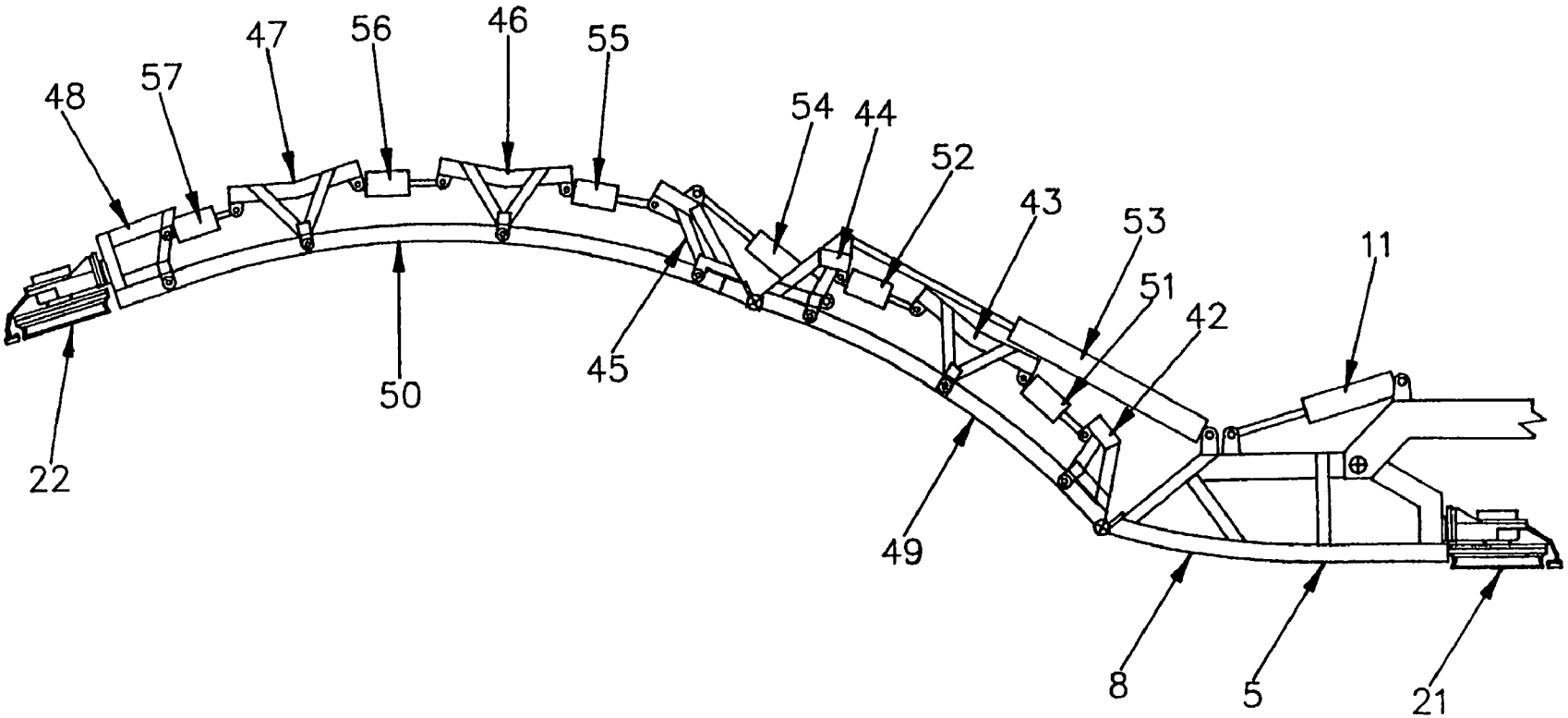
Figure 13:
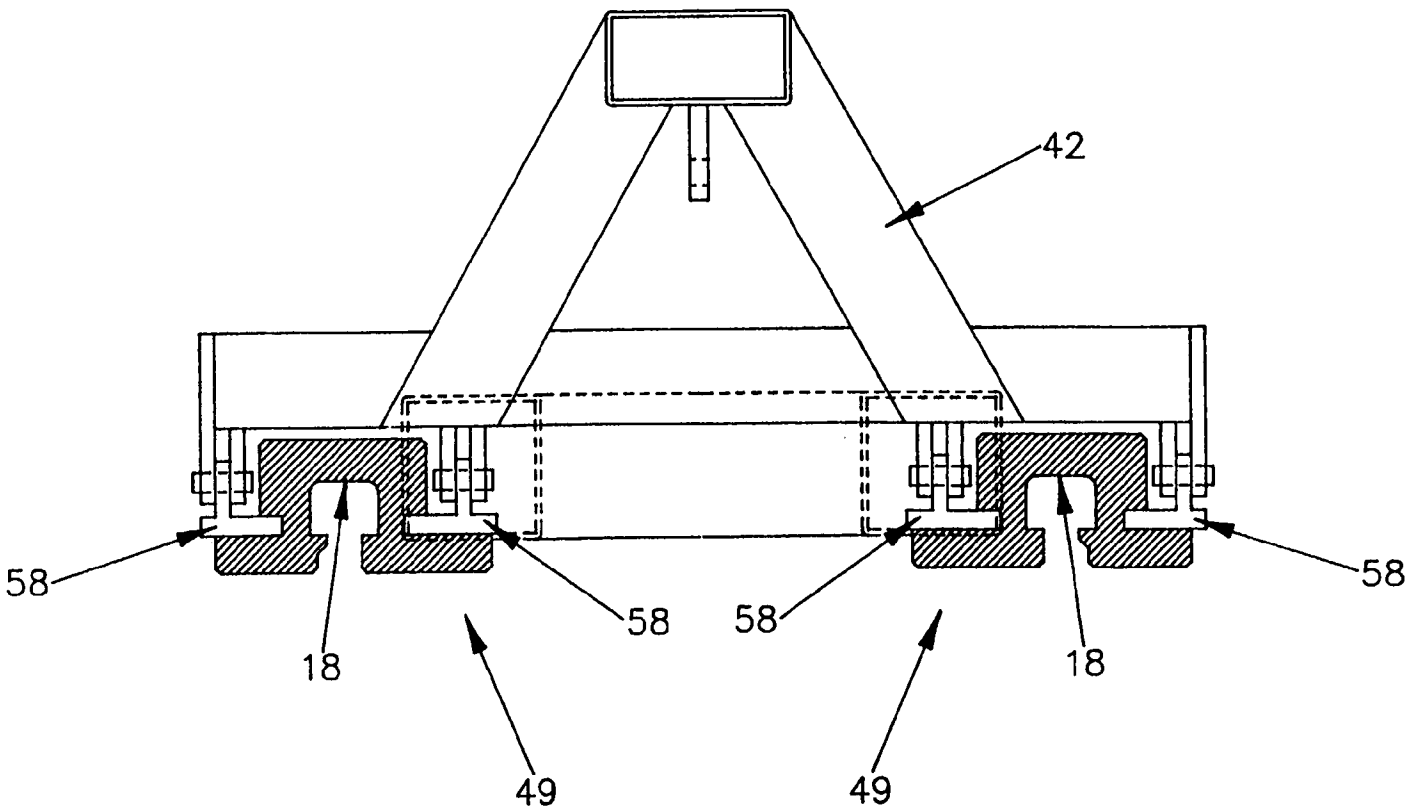

FIG. 13 shows a sectional view through the line AA shown in FIGS. 10 and 12. In the third embodiment, the working surface (49) is formed with a flexible track (18)—made of ultra-high molecular weight polyethylene (UHMWPE) attached to longitudinal elongated spring-steel elements (58) running longitudinally along both sides of each track (18) portion along the two longitudinal edges of the working surfaces (49). A corresponding configuration is present in the outermost working surface (50). The spring steel elements (58) provide the necessary mechanical strength and lateral rigidity (orthogonal to the direction of vehicle motion in typical use) required to ensure the correct operation of the conveying means (chain (19)) and associated tools in operation.

Figure 14:
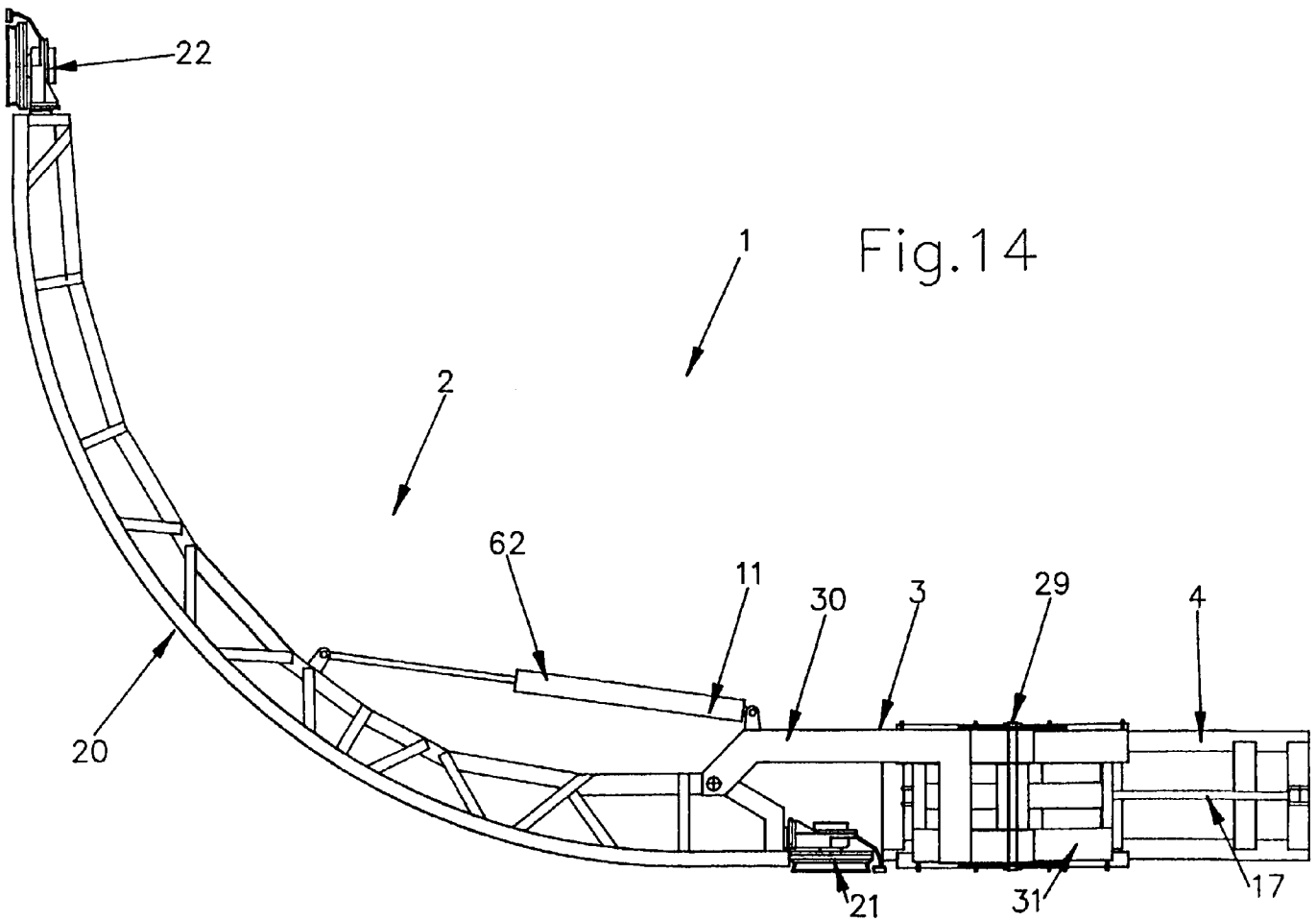

As will be evident to a person skilled in the art, a variety of permutations and combinations of the features disclosed in the aforesaid embodiment are possible. The use of the conveying means and attached tools as previously described, may be equally applied to a non-flexible, single section arm assembly (2) as shown in FIG. 14. In such a configuration, the plurality of individual actuators acting between the numerous sections may be dispensed with. Instead, the inclination of the whole arm (2) and associated single working surface (20) is adjustable by a single actuator (63). Naturally, such a design would be more constrained in its capabilities, though the manufacturing/maintenance costs would be lowered. It would also be possible to utilise more than one conveying means in a single working surface and/or section. Thus, the arrangement of conveying means shown in FIG. 6 may be duplicated on different working surfaces/sections or even on the same working surface/section. This could enable the use of completely different tools with each conveying means and/or for the separate conveying means to rotate in different directions. Each such conveying means could have an individual drive means or be driven (via suitable interconnection) by a common drive.

One or more sections may be formed from two or more sub-units which are pivotally connected together about one or more corresponding pivot axes parallel to the longitudinal plane of the working surface, i.e. orthogonal to the direction of the vehicle motion in normal use). Section (6*a*) in FIG. 9*d*) shows an exemplary schematic illustration of two such sub-units (59, 60) mutually pivotable about an axis (61). This would enable the inclination each such sub-unit to be angled to correspond to that of the immediately adjacent terrain surface. This could be accomplished passively, e.g. by allowing one or more suitably positioned support devices to allow the pivotable sub-units to flex in accordance with the terrain undulations traversed due to the vehicle movement. Alternatively, in a more sophisticated embodiment, suitable sensors may be employed to automatically control the position of each sub-unit according to either the terrain proximity and/or other considerations.

In FIG. 13, the lateral cross-section of working surface (49) is shown as essentially planar with the two portions of the track (18) along opposing longitudinal edges of said working surface (49) are substantially at the same vertical level. As discussed previously, one longitudinal portion of the track (18) may be vertically elevated with respect to the other assembly pivoting the whole arm assembly (2) about its horizontal longitudinal axis. However, this could also be achieved by forming each said longitudinal portion of track (18) as a separate such sub-unit (59, 60) and pivoting same about their said mutual axis (61) (shown in FIG. 9*d*)).

Alternative mechanisms include mechanically altering the relative heights of the mounting for either said track portion (18), i.e. the spring steel elements (58). This may be achieved by means of suitable drive/actuator means acting solely on one said longitudinal track (18) portions or via other mechanical linkages connected to same. In a further alternative, if the conveying means is not directly constrained within a track (18), then altering the lateral inclination and/or vertical height of one or more drive means (21, 22) can also alter the vertical separation between opposing portions of the conveying means along the longitudinal edges of a working section.

The same end result, i.e. only actively engaging the tools along one of the two longitudinal edges with the terrain surface may be achieved in a completely different manner by mounting the tools to the conveying means as described below, whilst permitting the whole working whole surface to remain level. If the tools were hinged to the conveying means such that the tools were held rigid by the force of interaction with the terrain surface in one longitudinal direction of travel (and optionally also in the lateral direction, i.e. the direction of vehicle movement), but were free to pivot in the opposite longitudinal (and—optionally—lateral) direction, then on the tools would offer no resistance to the terrain surface on their passage along the opposite longitudinal edge of the working surface.

In the foregoing specification, the present invention has been described with reference to 16. specific exemplary embodiments thereof. It will, however, be evident that various modifications and alterations may be made thereof without departing from the broader spirit and scope of the claims as set forth herein. The specification and drawings, are, accordingly, to be regarded in the illustrative rather than a restrictive sense.

What is claimed is:

1. An adjustable arm assembly attachable at one end to a suitable vehicle and capable of deployment substantially orthogonally to the direction of movement of said vehicle; said arm being elongated and including two or more articulatedly connected sections and one or more actuators capable of changing the orientation of at least two said sections with respect to each other; a lower or outer surface of at least one said section forming two substantially coplanar working surfaces; and a conveyor arranged to be driven in one direction along one said working surface and in the opposite direction along the second said working surface, said conveyor being provided with at least one tool adapted for interaction with a terrain surface.

2. The adjustable arm assembly of claim 1, wherein the lower or outer surfaces of two or more said sections form continuous working surfaces.

3. The adjustable arm assembly of claim 2, wherein said working surfaces of each section may be longitudinally curved or straight in the vertical plane.

4. The adjustable arm assembly of claim 3, wherein two or more of said working surfaces are of different lengths longitudinally or laterally.

5. The adjustable arm assembly of claim 4, wherein the longitudinal curvature of each working surface can be altered in the vertical plane by said actuators.

6. The adjustable arm assembly of claim 1, wherein each actuator is capable of altering an angle between adjacent sections to coil the arm assembly for transport or storage and to uncoil the arm assembly for use.

7. The adjustable arm assembly of claim 6, wherein said actuators are attached between adjacent sections and between an attached end of said arm and a vehicle mounting assembly.

8. The adjustable arm assembly of claim 7, wherein separate conveyors are provided for each section.

9. The adjustable arm assembly of claim 8, wherein each conveyor is separately provided with at least one drive.

10. The adjustable arm assembly of claim 9, wherein said conveyor is constrained by a slotted track on each working surface with each tool projecting outwardly from said track.

11. The adjustable arm assembly of claim 10, wherein said conveyor is constrained to move within a closed path and around at least two direction-changing devices.

12. The adjustable arm assembly of claim 11, wherein at least one said direction-changing device is a drive.

13. The adjustable arm assembly of claim 12, wherein at least one section is formed from two sub-units which may be pivoted with respect to each other about a mutual pivot axis orthogonal to the direction of movement of said vehicle.

14. The adjustable arm assembly of claim 13, wherein the vertical elevation of the portion of the conveyor along one longitudinal edge with respect to the portion of the conveyor along the opposing longitudinal edge is adjustable by pivoting said sub-units about said mutual pivot axis.

15. The adjustable arm assembly of claim 11, wherein portions of said conveyor intermediate said direction-changing devices are substantially parallel and extend substantially along opposing longitudinal edges of said working surfaces.

16. The adjustable arm assembly of claim 15, wherein said portion of the conveyor along one longitudinal edge of at least one working surface is vertically elevated with respect to said portion of the conveyor along the opposing longitudinal edge of the opposing working surface.

17. The adjustable arm assembly of claim 16, wherein the vertical elevation of the portion of the conveyor along one longitudinal edge with respect to the portion of the conveyor along the opposing longitudinal edge is adjustable.

18. The adjustable arm assembly of claim 17, wherein the vertical elevation is adjustable by pivoting the arm assembly about a horizontal axis co-planar with a longitudinal axis of the arm assembly.

19. The adjustable arm assembly of claim 17 or claim 18, wherein the vertical elevation is adjustable by pivoting or height adjusting at least one of the direction-changing devices.

20. The adjustable arm assembly of claim 1, wherein said conveyor is selected from the group consisting of a chain, a belt, a rope, a wire and a hawser.

21. The adjustable arm assembly of claim 1, wherein said tool is adapted for cutting, scraping, pushing, packing, smoothing or rolling said terrain surface.

22. The adjustable arm assembly of claim 1, wherein said terrain surface includes snow, ice, sand, soil, mud, building debris, grass, crops, undergrowth, coal, aggregate, or particulate substances.

23. The adjustable arm assembly of claim 1, wherein the at least one tool is selected from the group consisting of a paddle, a scraping element, a rasping element, a cutter shaft, a spiral cutter, a brushing roller, and a pick-up roller.

24. The adjustable arm assembly of claim 1, wherein the at least one tool is rotatably mounted.

25. The adjustable arm assembly of claim 1, wherein said arm assembly is pivotably attachable to said vehicle about a vertical axis, enabling each section to be pivoted for deployment on either side of said vehicle.

26. The adjustable arm assembly of claim 1, wherein said arm assembly may be moved in a vertical plane.

27. The adjustable arm assembly of claim 1, wherein said arm assembly may be moved transversely to the direction of movement of the vehicle.

28. The adjustable arm assembly of claim 1, wherein the arm assembly may be at least partially rotated about an axis in a horizontal plane.

29. The adjustable arm assembly of claim 1, wherein one or more supporting devices are located at predetermined fixed positions about one or more working surfaces.

30. The adjustable arm assembly of claim 29, wherein said predetermined fixed positions include longitudinal edges of said working surfaces or between said working surfaces.

31. The adjustable arm assembly of claim 30, wherein at least two of said supporting devices are laterally offset with respect to each other.

32. The adjustable arm assembly of claim 31, wherein one or more of the supporting devices are formed as the tool.

33. The adjustable arm assembly of claim 32, wherein one or more of the supporting devices are configured to contact the terrain surface during use to thereby provide support by transferring at least a portion of the arm assembly weight to the terrain surface.

34. The adjustable arm assembly of claim 1, wherein at least one section is independently pivotable with respect to an adjacent section about an axis orthogonal to a direction of movement of the arm assembly when deployed and in use.

35. The adjustable arm assembly of claim 1, wherein one or more flexible grooming elements may be affixed to a longitudinal edge of one or more working surfaces facing away from the direction of movement of said vehicle, and are configured such that a trailing edge of each grooming element is wiped across an adjacent terrain surface when in use.

36. The adjustable arm assembly of claim 35, wherein said grooming elements are detachable.

37. The adjustable arm assembly of claim 36, wherein said grooming elements are movable between an in-use position and a stand by position, whereby said grooming elements are retained in the stand-by position, out of contact with the terrain surface.

38. The adjustable arm assembly of claim 37, wherein said grooming elements are located along opposing longitudinal edges of said working surfaces.

39. The adjustable arm assembly of claim 1, wherein said arm assembly is integrally attached to said vehicle.

40. The adjustable arm assembly of claim 1, wherein said arm assembly is pivotably attachable to said vehicle by a detachable vehicle mounting assembly.

41. The adjustable arm assembly of claim 1, wherein the at least one tool is hinged to move freely in one direction along a longitudinal axis of the sections, but is fixed in the reciprocal direction.

42. The adjustable arm assembly as of claim 1, wherein the at least one tool is hinged to move freely in one direction orthogonal to a longitudinal axis of the sections, but is fixed in the reciprocal direction.

43. The adjustable arm assembly of claim 1, wherein said conveyor is capable of bi-directional movement.

44. The adjustable arm assembly of claim 1 or claim 40, in combination with a snow grooming machine.

* * * * *